United States Patent [19]

Jahn

[11] 3,977,144

[45] Aug. 31, 1976

[54] SUSPENDED CEILING STRUCTURE, PARTICULARLY FOR DRY-WALL TYPE PANELS

[75] Inventor: Martin D. Jahn, Riverside, Ill.

[73] Assignee: Chicago Metallic Corporation, Chicago, Ill.

[22] Filed: Jan. 11, 1974

[21] Appl. No.: 432,469

[52] U.S. Cl. ..... 52/495; 52/498; 52/664; 52/741

[51] Int. Cl.[2] ..... E04B 5/52

[58] Field of Search ..... 52/DIG. 5, 484, 664, 52/666, 667, 494, 495, 498, 741

[56] References Cited

UNITED STATES PATENTS

| | | | |
|---|---|---|---|
| 1,789,827 | 1/1931 | McKay | 52/484 |
| 2,286,976 | 6/1942 | Roberts | 52/484 |
| 2,667,667 | 2/1954 | Jacobson | 52/489 |
| 3,015,375 | 1/1962 | Lickliter et al. | 52/665 |
| 3,031,042 | 4/1962 | Drackett | 52/484 |
| 3,032,833 | 5/1962 | Stanley | 52/664 |
| 3,084,401 | 4/1963 | Findlay | 52/667 |
| 3,283,467 | 11/1966 | Znamirowski | 52/667 |
| 3,342,515 | 9/1967 | Jahn | 52/664 |
| 3,356,402 | 12/1967 | Smith | 52/484 |
| 3,706,171 | 12/1972 | Shayman | 52/515 |
| 3,724,356 | 4/1973 | Lambert | 52/DIG. 5 X |
| 3,765,141 | 10/1973 | Shayman | 52/484 X |

*Primary Examiner*—Ernest R. Purser
*Assistant Examiner*—William Randolph
*Attorney, Agent, or Firm*—Hill, Gross, Simpson, Van Santen, Steadman, Chiara & Simpson

[57] ABSTRACT

A ceiling structure, particularly for "dry-wall" type panels, employing a suspended ceiling grid structure having a plurality of parallel main runners and a plurality of parallel cross runners extending transversely to, and having their ends engaged with the main runners to form a rectangular grid structure, with each of the runners having flange means adapted to support a ceiling panel around the periphery thereof, the ceiling panel being reinforced by at least one cross member extending along the upper face of such ceiling panel and is secured thereto.

In a preferred form of the invention, the ceiling panels are adapted to be successively installed in the grid structure with the associated reinforcing members being installed in operative position and secured to the associated panel following installation of the latter by means of screws or a suitable adhesive. Preferably, the reinforcing members are interlocked at least at one end with an adjacent runner to restrict upward movement of the reinforcing member with respect to such runner. The reinforcing member may be so designed that it is snapped into operative engagement, at each end thereof, with an adjacent runner, or provided with means extending through an opening in the adjacent runner and forming stop means for determining the lateral positioning of a corresponding reinforcing member cooperable with the following adjacent ceiling panel.

14 Claims, 7 Drawing Figures

SUSPENDED CEILING STRUCTURE, PARTICULARLY FOR DRY-WALL TYPE PANELS

BACKGROUND OF THE INVENTION

The invention is directed to a suspended ceiling structure, particularly for use with dry-wall type panels, for example plasterboard or the like.

In the past, suspended ceilings employing suspended grid structures in which are supported ceiling tiles or panels which, have heretofore normally been produced in various sizes, for example, 2 × 2 feet, and 2 × 4 feet. Dry-wall type panels, for example plasterboard sheets, are normally produced in the standard size of 4 × 8 feet, and while such panels have, in the past, been employed with a grid structure of the suspended type, usually employing standard type grid structures, the panels following installation of the grid structure, have been positioned in operative position below the grid structure in engagement therewith, with panel edges in alignment with the runners of the grid structure and secured thereto by drive screws or the like, applied with power equipment, which may be readily driven through the plasterboard into the usual flange of the suspended ceiling structure, enough screws being disposed around the periphery to insure adequate attachment of the panel around its peripheral edges. Normally, the grid structure of the suspended ceiling employed modules of less size than the 4 × 8 feet dry wall ceiling panels, i.e., 2 × 4 feet or possibly 4 × 4 feet, whereby the panel may also be secured by drive screws to the intermediate runners defining the smaller grid modules to suitably attach the ceiling panel along intermediate lines. Following attachment of the ceiling panels the joints and heads of the mounting screws may be covered with tape and suitably finished off in accordance with standard dry-wall techniques.

It will be appreciated that where relatively large dry-wall panels are employed, for example, of 4 × 8 feet dimensions, while theoretically such panels could be placed in the grid structure from above similar to the standard ceiling tiles and supported by the grid structure at the peripheral edges of the panel, the size of the panel with respect to its thickness is such that if supported only around the peripheral edges, the central portion of the panel would tend to sag and means thus must be provided for stiffening and reinforcing the intermediate portion or portions of the panel to insure a desired planar exposed surface. At the same time, the construction must be such that it is simple both as to the members employed and the assembly, and that does not require a complex or difficult installation, whereby the average installer can readily install such type of ceiling without undue difficulty

BRIEF SUMMARY OF THE INVENTION

The invention is, therefore, directed to a solution of such problem, in which 4 × 8 feet panels may be readily accommodated and suitably reinforced to provide a very simple yet highly efficient structure.

This is accomplished by the utilization of a more or less standard grid structure, employing a plurality of parallel main runners and cooperable parallel transversely extending cross runners, which are secured at their ends to the main runners to form a rectangular grid structure, in which the main and cross runners define areas, each of which are of a size to receive a ceiling panel, for example, a dry-wall type of plasterboard panel, and support the same along its peripheral edges. Such runners may embody interlocking constructions of known types, and may employ runners of inverted T-shape in transverse cross section, comparable to the usual type of suspended grid runner. Preferably, however, such runners are of somewhat heavier construction and provided with wider flanges for the support of the ceiling panels. For example, the standard runner usually employs a base portion defining oppositely disposed flanges, having an overall width of 15/16 inch whereas, preferably a runner for use with the present invention would have a width of approximately 1-⅜ inch.

The runners preferably are each provided with an enlarged head extending longitudinally along the top edge of the intermediate or web portion of the runner which may be used for interlocking with at least one end of a suitable reinforcing member disposed on the upper surface of the panel and secured thereto. Preferably, the main or cross runners may be provided with vertical slots at suitable intervals therealong adapted to receive a projection or tongue extending from the cooperable end of such a reinforcing member. Such tongue may be so proportioned that it also may function as a stop for the adjacent end of a reinforcing member associated with the next adjacent ceiling panel, enabling the installer to readily position a following reinforcing member in alignment with that associated with a previously installed panel.

Where the reinforcing member is engaged with the bead of the cooperable runner, the reinforcing member may be so designed that it may be snapped into place by slightly springing the cooperable runner to permit the desired interlocking.

BRIEF DESCRIPTION OF THE DRAWINGS

In the drawings wherein like reference characters indicate like or corresponding parts:

FIG. 1 is an isometric figure of a portion of a ceiling structure illustrating the installation and attachment of a ceiling panel to a reinforcing member, utilizing drive screws or the like;

DETAILED DESCRIPTION OF PREFERRED EMBODIMENTS OF THE INVENTION

Figure 1:
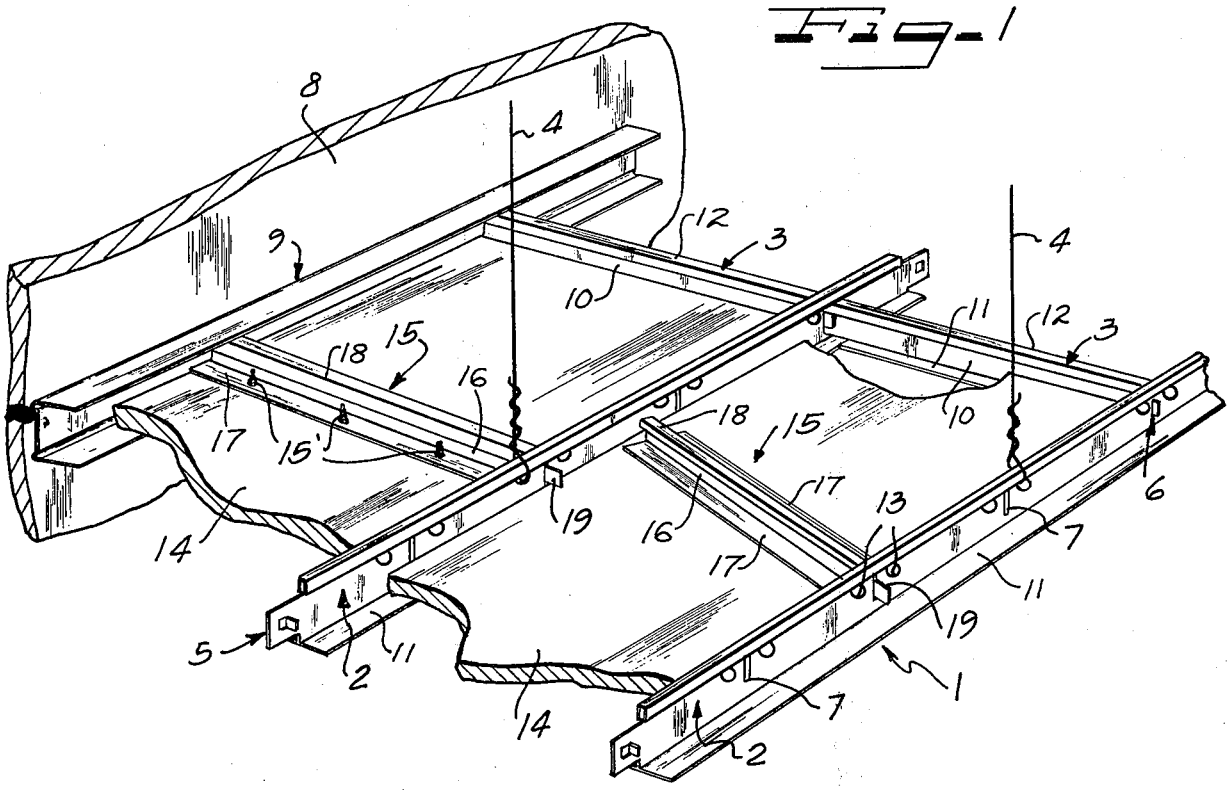
Figure 2:
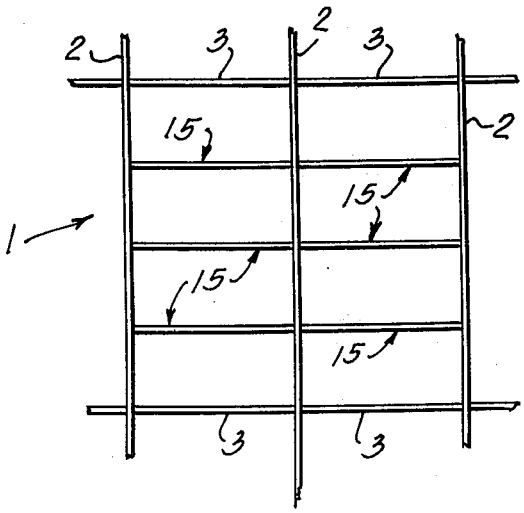
FIG. 2 is a semi-diagrammatic plan view of a portion of a ceiling structure illustrating a suitable disposition of the reinforcing members with respect to the main and cross runners.

Referring to FIGS. 1 and 2, the reference numeral 1 indicates generally a suspended ceiling grid structure comprising a plurality of spaced parallelly extending main runners 2, which are interconnected by a plurality of spaced parallel cross runners 3. The grid structure may be supported by suitable means as, for example, tie members 4 extending from the main runners 2. The grid system illustrated in FIG. 1, thus far described, is known commercial construction in which the main runner sections are adapted to abut end-for-end and suitably rigidly connected, for example by interlocking means indicated generally by the numeral 5 on each of the abutting ends. The cross runners 3 are of a length to extend between adjacent pairs of main runners and are suitably interlocked therewith, the construction illustrated employing a tongue 6 on each end of the cross member adapted to be inserted in cooperable slots 7 in the main runners. Preferably, the construction is such that the ends of the cross runner are effectively interlocked with the main runner preventing both lateral and separating movement of the cross runners with respect to the associated main runners.

Figure 3:
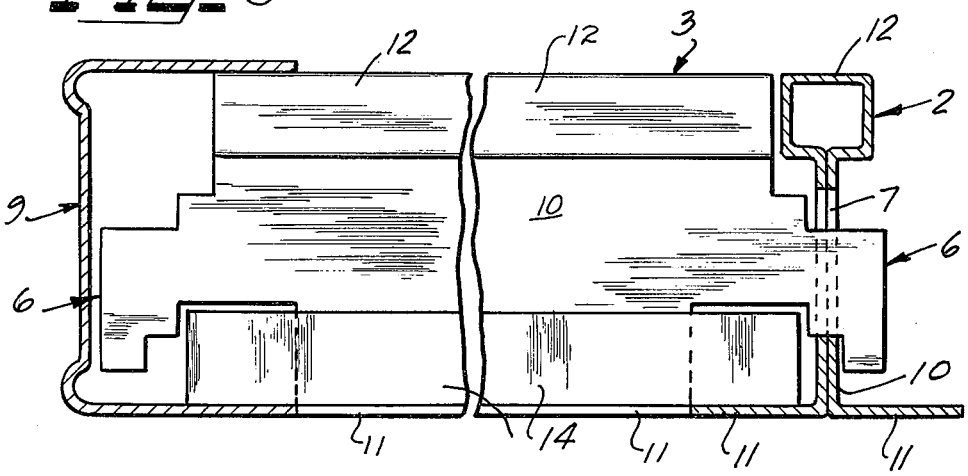
FIG. 3 is a side elevational view of a cross runner illustrating one form of connection thereof to a main runner and to a wall supported member at the outer periphery of the ceiling structure.

The grid structure may be finished off along the adjacent walls, such as the wall 8, by channel members 9 suitably mounted on the wall in the general plane of the runners and adapted to receive the adjacent ends of the cross or main runners, as clearly illustrated in FIGS. 1 and 3.

The main and cross runners illustrated are of generally like construction, having an inverted T-shaped configuration in transverse cross-section, as more clearly illustrated in FIGS. 3, 4, 6 and 7, and may be of either single or double walled construction in accordance with known techniques in the suspended ceiling field. For illustrative purposes a simple double walled construction is depicted. With either construction, there is formed a runner having an intermediate web portion 10, terminating at its lower edges in oppositely disposed aligned panel supporting flanges 11, and preferably formed at its upper longitudinal edge with a tubular bead 12, illustrated in the drawings as being of rectangular cross-section configuration. The main runner may be provided with a plurality of previously mentioned slots 7, disposed at spaced intervals along the runner, as well as openings 13 for receipt of ties 4. By providing the openings 7 and 13 at spaced intervals along the main runner, for example, at eight inch intervals, assuming the main runner to have an eight or twelve-foot length, the ties and cross runners may be disposed at the most convenient locations, in dependence upon the specific ceiling arrangement.

The supporting grid structure thus far described may be installed in the usual manner, utilizing known layout and assembly techniques with the main and cross runners defining a plurality of rectangular-shaped grid openings or areas, each bounded by a pair of main runners and a pair of cross runners, which areas are of a size to receive a cooperable ceiling panel 14 and support the same about its peripheral edges from the flanges 11 of the respective runners. Normally, the grid openings or areas would be of a size to accomodate a standard 4 × 8 foot sheet of drywall, i.e., plaster-board or the like, which could, for example, have a thickness of from ½ to ⅝ inch or more. While smaller sized panel sheets could be employed, with a smaller size grid opening or area, this would necessitate additional runner structures and additional joints in the assembled ceiling without serving any useful purpose.

Assuming a 4 × 8 foot panel, it will be appreciated that relatively large spans are involved across the face of the panel, as compared with its thickness thereof, which would result in a tendency of the central portion of the panel to sag. To prevent this condition, reinforcing members 15 are provided, preferably three such reinforcing members being employed with a 4 × 8 foot panel.

Figure 4:
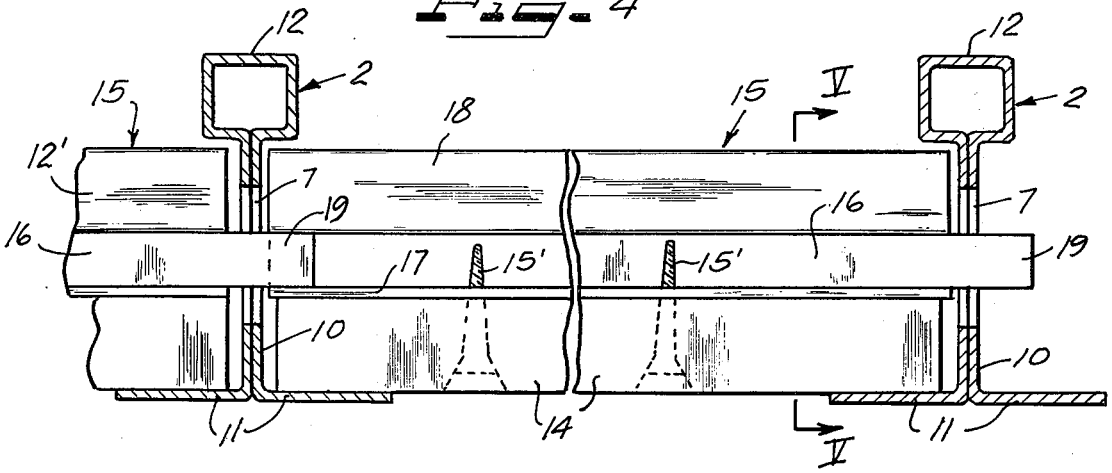
FIG. 4 is a similar side elevational view of a reinforcing member illustrating its connection to two spaced runners.
Figure 5:
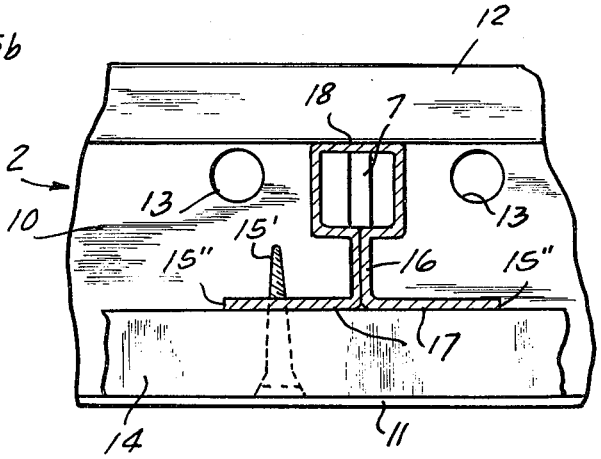
FIG. 5 is a sectional view taken approximately on the line V—V of FIG. 4.

Details of the reinforcing member 15 illustrated in FIG. 1 are illustrated in FIGS. 4 and 5, from which it will be noted that in such embodiment the latter likewise is of generally inverted T-shape in transverse cross-section, constructed from a single sheet of material to provide a web portion 16 of double thickness, terminating at its lower longitudinal edge in outwardly disposed flanges 17 and at its upper edge in a bead 18, illustrated as being of rectangular transverse cross-section, with the flanges 17 being adapted to engage the upper surface of the panel 14. The intermediate web portion 16 has a vertical height such that the bead 18 may be disposed below the beads 12 of the main runners, as clearly illustrated in FIGS. 4 and 5.

As illustrated in FIGS. 1 and 4, one end of the reinforcing member 15, i.e., the right-hand end as viewed in FIG. 4, is provided with a longitudinally extending tongue 19 of a size to extend through a cooperable slot 7 in a main runner. Likewise, as illustrated in FIGS. 4 and 5, as the end portion of the bead 18 may be disposed directly below the adjacent bottom edge of the bead 12 of the main runner, movement of the reinforcing member in upward direction relative to the main runner is restricted. The opposite end, i.e., the lefthand end of the reinforcing member as viewed in FIG. 4, has an end face lying in a plane extending at right angles to the axis of the reinforcing member and thus has no special configuration. The length of the runner is such, however, that the unformed end of the reinforcing member may be disposed below the bead 12 of the cooperable main runner. The reinforcing member thus is engaged at both ends with a respective cooperable main runner whereby upward movement of both ends of the reinforcing member is restricted.

METHOD OF ASSEMBLY

In assembling the construction illustrated in FIGS. 1–5, following the installation of the grid structure, comprising the main and cross runners, a ceiling panel is placed in one of the grid areas formed by the main and cross runners, or if a peripheral area, by a wall mounted channel 9, a cooperable main runner and a pair of cross runners or vice versa. The desired number of reinforcing members may then be disposed at the upper face of the panel and the installer, positioned at one side of a main runner carrying such panel, then inserts the tongue 19 of the reinforcing member through a desired slot 7, with the reinforcing member extending at an angle or less than 90° with respect to the main runner with which it is interlocked, a sufficient distance to clear the bead of the oppositely disposed main runner or the upper flange of the channel 9.

With the flanges of the reinforcing member laying on the upper surface of the panel, the installer then pivots the member about the connection of the tongue 18 with the cooperable main runner, swinging the opposite free end of the reinforcing member in a direction to position the latter at right angles to the respective main runners or main runner and channel. This movement also brings the end portion of the bead of the reinforcing member under the bead of the cooperable main runner or under the flange of the channel member 9 and thereby restricts upward movement of such end of the reinforcing member. Where the panel involved is not a peripheral panel adjacent a wall, the tongue 19 may extend a sufficient distance through the associated main runner to form an abutment or stop for such free end of the next reinforcing member as it is swung into engagement with the associated main runner, as indicated by the arrow in FIG. 1 with the tongue 19 abutting the adjacent end of the intermediate portion 16 of the reinforcing member 15 and thereby insuring alignment of all successive reinforcing members.

Following disposition of a reinforcing member in the desired position, the latter may be secured to the upper face of the panel by suitable means, that illustrated in FIGS. 1, 4 and 5 comprising screws, such as drive screws 15 ' which may be driven into mounting relation from underneath the panel 14, utilizing suitable power equipment which will readily drive the screws through the plasterboard and through one of the flanges 17 of the reinforcing member. Normally, where merely screws are employed, three such screws, suitably positioned, will be adequate for the desired purposes.

If desired, the reinforcing member may be adhesively bonded to the panel, employing a suitable cement or adhesive 15'' of which there are various types available.

Thus, in applying the respective panels, each panel will be mounted in position successively. In some cases, it may be desirable to employ a suitable length of reinforcing member and secure the same to the panel prior to installation thereof, with the ends of the reinforcing member spaced from the peripheral edges of the panel to provide a reinforced panel which may be dropped into the grid structure. Likewise, it may be desirable to employ such a reinforced panel in a system such as illustrated in FIGS. 1 and 2, utilizing such reinforced panels merely as access panels which may be moved upwardly to provide access above the ceiling structure.

MODIFIED STRUCTURES

Figure 6:
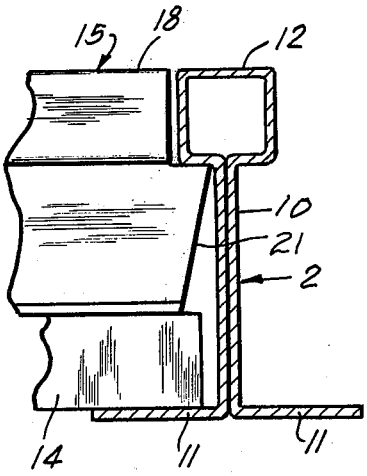
FIG. 6 is a side elevational view of one end portion of a modified reinforcing member illustrating its engagement with a main runner.

FIG. 6 illustrates a modified construction of the end of a reinforcing member, in which the latter is provided with an abutting edge 20 adapted to seat beneath the bead 12 of the main runner, with the end edge 21 of the intermediate portion of the reinforcing member being inclined rearwardly away from the juncture thereof with the abutment 20. The edge 21 thus forms a cam surface by means of which the reinforcing member, following suitable engagement of the opposite end thereof with the other main runner or channel, is disposed above the bead 12 of the main runner and by applying downward pressure on the adjacent end of the reinforcing member the edge 21 will function as a cam member springing the main runner sufficiently to permit the abutment edge to pass down below the bead 12 with the main runner resuming its original position as soon as the edge 20 has cleared the bead. As illustrated, in this contruction the beads 18 of the reinforcing members are in alignment with the beads 12 of the runners.

Figure 7:
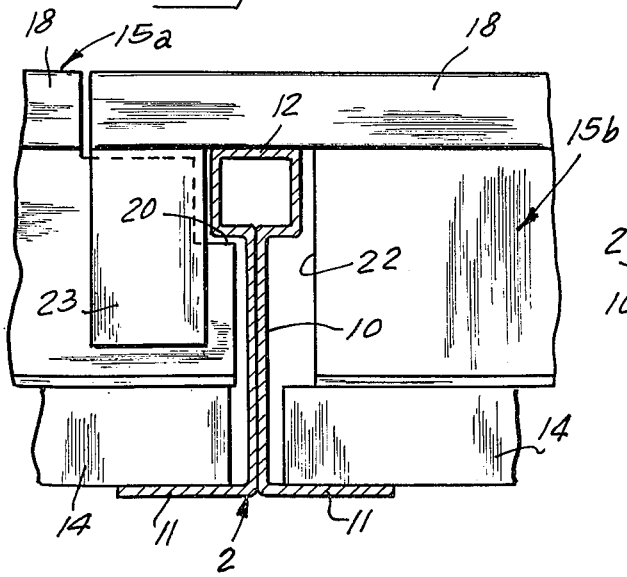
FIG. 7 is a similar figure illustrating a further modification in the construction of the reinforcing members.

FIG. 7 depicts the end portions of two reinforcing members 15*a* and 15*b*, such end portions thus corresponding to the respective ends of a single reinforcing member, and illustrates a further modification of the reinforcing member. In this construction one end of the member 15*a* is provided with an abutment edge 20 adapted to seat under the bead 12 of the cooperable main runner, in a manner similar to the construction illustrated in FIG. 6, but in this case the end of the reinforcing member is adapted to be so engaged by laying the reinforcing member flat on the upper surface of the panel, with the reinforcing member angularly disposed with respect to the main runner, and thereafter pivoting the adjacent end into a right angle position with respect to such main runner, thus bringing the abutment 20 beneath the head 12 as illustrated. In this construction, the intermediate web portion 16 of the reinforcing member has a vertical height sufficient to dispose the bead 18 thereof above the bead 12 of the main runner.

The illustrated end of the reinforcing member 15*b* (corresponding to the opposite end of the runner 15*a*) is provided with a notch 22 therein, spaced longitudinally from the free end of the reinforcing member, with the flange portions terminating at the inner edge of the notch, forming a projection or tongue 23 at the extreme end of the runner. The notch 22 is of a size to receive the bead 12 of the main runner permitting the projection 23 to be disposed at the opposite side of the main runner as clearly illustrated in FIG. 7. Alignment of such ends of a pair of adjacent reinforcing members is permitted by removal of the end portion of the bead 18 adjacent the abutment 20 whereby the adjacent bead portion 18 of the other reinforcing member may be accommodated.

It will be appreciated from the above description that I have provided a novel ceiling structure, which may utilize ceiling panels of the dry-wall type, with the panels being adequately supported to insure a planar ceiling, and at the same time provide a construction which may be very easily assembled, utilizing merely a few additional steps over that involved in the normal suspended ceiling.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A suspended ceiling structure for supporting a plurality of rectangular sheet-like panels, particularly for relatively large dry-wall type panels having a sufficiently large area relative to their thickness that, when peripherally supported, the intermediate portion thereof would tend to sag out of its normal plane, comprising a suspended ceiling grid structure having a plurality of parallel main runners and a plurality of cross runners assembled therewith, to form a rectangular grid structure, each of said runners having an inverted T-shape in transverse cross section to provide a central web portion having outwardly extending panel-supporting flanges at the lower edge thereof, each pair of main runners and pair of cross runners assembled therewith defining a rectangular area, the long sides of which are defined by the main runners and the short sides of which are defined by the cross runners with said area having a size between oppositely disposed web portions of such assembled runners to receive a cooperable rectangularly shaped panel having respective lateral dimensions greater than the corresponding dimensions of said rectangular area, with the peripheral edge portions of the latter disposed adjacent such web portions and overlying and resting upon the associated flanges, said runners being so proportioned relative to the panel that the assembly of the respective panels may be effected subsequent to the assembly of the suspended ceiling grid structure, and a disposition of each panel in a position above the adjacent flanges of a pair of main runners and a cooperable pair of cross runners, and the lowering of the panel between said web portions onto such flanges for support thereby, and at least one unitary panel-reinforcing member longitudinally aligned with, and its ends substantially abutting the web portions of the adjacent main runners whereby the peripheral edge portions of the panel thereat are disposed between the flange of the adjacent main runner and the end portion of the reinforcing member, the latter having a vertically extending portion terminating at its lower edge in a horizontally extending flange seated upon the upper face of said panel, which flange extends substantially coextensive with the cooresponding dimension of the latter, at least one end of said reinforcing member having means disposed adjacent to and detachably interlocked with the adjacent main runner, restricting upward movement of said reinforcing member and said panel thereat, and means extending upwardly through the panel and into the planar portion of the reinforcing member to rigidly secure the intermediate portion of the panel to the planar portion of said reinforcing member to prevent sagging of the panel thereat.

2. A ceiling structure according to claim 1, wherein the runner engaging means, at one end of said reinforcing member, is so interlocked with means on the cooperable runner that lateral movement of such end of the reinforcing member longitudinally along such runner is restricted.

3. A ceiling structure according to claim 2, wherein the opposite end of the reinforcing member is slidably movable longitudinally along the adjacent runner and engageable with the first-mentioned end of a reinforcing member associated with an adjacent ceiling panel for locating said opposite end of alignment with said other reinforcing member.

4. A ceiling structure according to claim 3, wherein said runners are provided at the upper edge thereof with an enlarged longitudinally extending tubular bead, said reinforcing member being constructed at said opposite end thereof for engagement with a cooperable bead to limit upward movement of such end of the reinforcing member relative to the runner.

5. A ceiling structure according to claim 4, wherein the first-mentioned end of the reinforcing member is contructed for engagement with the bead of the adjacent runner whereby upward movement of both ends of the reinforcing member is restricted.

6. A ceiling structure according to claim 3, wherein said opposite end of such reinforcing member is provided with an end portion adapted to extend over the adjacent runner and abut the adjacent end portion of a like reinforcing member associated with the adjacent panel.

7. A ceiling structure according to claim 3, wherein the first-mentioned end of the reinforcing member is provided with a longitudinally extending tongue extending through a slot in the cooperable runner

8. A ceiling structure according to claim 7, wherein said tongue has a length to extend from the opposite side of the runner a sufficient distance to form an abutment for locating a reinforcing member associated with the following adjacent ceiling panel.

9. A ceiling structure according to claim 1, wherein said runners are provided at their respective upper edges with an enlarged longitudinally extending tubular bead, said reinforcing member being constructed, at least at one end, for sliding movement longitudinally along the adjacent runner and engagement with the bead of such adjacent runner to limit upward movement of such end of the reinforcing member relative to the runner.

10. A ceiling structure according to claim 9, wherein such end of the reinforcing member has an inclined edge engageable with such runner for laterally moving the runner to enable engagement thereof.

11. A ceiling structure according to claim 1, wherein said means for securing the reinforcing member to the panel comprises screw means extending upwardly through the panel and attached to the reinforcing member.

12. A method of forming a suspended ceiling structure, particularly structures employing relatively large dry-wall type panels having a sufficiently large area relative to their thickness that, when peripherally supported, the intermediate portion thereof would tend to sag out of its normal plane, comprising the steps of first assembling a generally planar suspended ceiling grid structure from a plurality of main and cross runners, each of an inverted T-shape in transverse cross-section with a central web portion terminating at its lower edge in outwardly directed panel-supporting flanges, each pair of main runners and cooperable pair of cross runners assembled therewith defining a rectangular area, the long sides of which are defined by the main runners and the short sides of which are defined by the cross runners, with said area having a size between oppositely disposed web portions of such assembled runners to receive a cooperable rectangularly shaped panel with the peripheral edge portions of the latter disposed adjacent such web portions and overlying and resting upon the associated flanges, thereafter lying and resting upon the associated flanges, thereafter assembling a panel with the assembled grid structure by positioning the panel edges above the adjacent flanges of the main and cross runners defining the receiving area for such panel, then lowering the panel into the plane of said grid structure with the peripheral panel edges resting upon and supported by the adjacent runner flanges, thereafter placing, from an adjacent open grid area, a unitary reinforcing member upon the upper face of such installed panel, said reinforcing member having an upwardly extending portion terminating at its lower edge in a planar flange of a length to extend substantially from the web portion of one main runner to the web of the other main runner, and being disposed with said flange in flat engagement with the upper face of such assembled panel, engaging one of the ends of said reinforcing member with a portion of the adjacent main runner to prevent upward movement of the ceiling panel and such end of the reinforcing member relative to such runner, disposing the opposite end of the reinforcing member adjacent the opposite main runner with said planar flange in flat engagement with the upper face of said panel, maintaining the opposite end of the reinforcing member stationary with respect to the adjacent peripheral portion of the panel to maintain such flat engagement of said planar flange of the reinforcing member with the upper face of the panel, and securing the panel to such planar flange to prevent sagging of the panel thereat, and thereafter, in like manner, successively installing respective pairs, each of which comprises a panel and cooperable reinforcing member.

13. A method according to claim 12, comprising initially engaging one end of the reinforcing member with an adjacent portion of the grid structure, and extending securing means through the panel from the underside thereof, into reinforcing member adjacent said engaged end of the reinforcing member to secure the panel thereto.

14. A method according to claim 12, comprising securing said panel to the reinforcing member by extending securing means upwardly through the panel into the planar flange of the reinforcing member.

* * * * *